United States Patent [19]

Uchida et al.

[11] Patent Number: 4,598,869

[45] Date of Patent: Jul. 8, 1986

[54] BOBBIN DISTRIBUTING DEVICE

[75] Inventors: Hiroshi Uchida, Oumihachiman; Tsukasa Kawarabashi, Kyoto, both of Japan

[73] Assignee: Murata Kikai Kabushiki Kaisha, Japan

[21] Appl. No.: 540,008

[22] Filed: Oct. 7, 1983

[30] Foreign Application Priority Data

Oct. 12, 1982 [JP] Japan ..... 57-155035[U]
Jul. 19, 1983 [JP] Japan ..... 58-131528

[51] Int. Cl.[4] ..... B65H 67/06

[52] U.S. Cl. ..... 242/35.5 A; 57/276; 57/281; 209/927

[58] Field of Search ..... 242/35.5 A, 35.5 R, 242/35.6 R; 57/276, 281; 209/903, 912, 927, 933, 558

[56] References Cited

U.S. PATENT DOCUMENTS

| | | | |
|---|---|---|---|
| 2,459,309 | 1/1949 | Cotchett | 209/927 X |
| 3,049,231 | 8/1962 | Crandall et al. | 209/927 X |
| 3,195,298 | 7/1965 | Furst | 242/35.5 A X |
| 3,207,307 | 9/1965 | Means | 209/927 X |
| 3,305,087 | 2/1967 | Lucker | 209/927 X |
| 3,334,740 | 8/1967 | McCollough et al. | 209/927 X |
| 3,405,877 | 10/1968 | Jenny | 242/35.5 R |
| 3,563,376 | 2/1971 | Zegna et al. | 209/927 X |
| 3,606,012 | 9/1971 | Brouwer | 209/927 X |
| 4,181,228 | 1/1980 | Hashimoto et al. | 209/927 X |
| 4,295,569 | 10/1981 | Niederer | 209/927 X |

*Primary Examiner*—Stanley N. Gilreath
*Attorney, Agent, or Firm*—Spensley Horn Jubas & Lubitz

[57] ABSTRACT

A device for discriminating and distributing the bobbins, which are discharged from a textile machine such as an automatic winder, in accordance with the quantity of yarns wound on the bobbin and/or the kinds thereof. The device includes sensors, a bobbin chucking means made movable which chucking the bobbin to distribute the bobbin, and guide means for guiding the movement of the chucking means operated in accordance with the instruction of the sensors.

14 Claims, 14 Drawing Figures

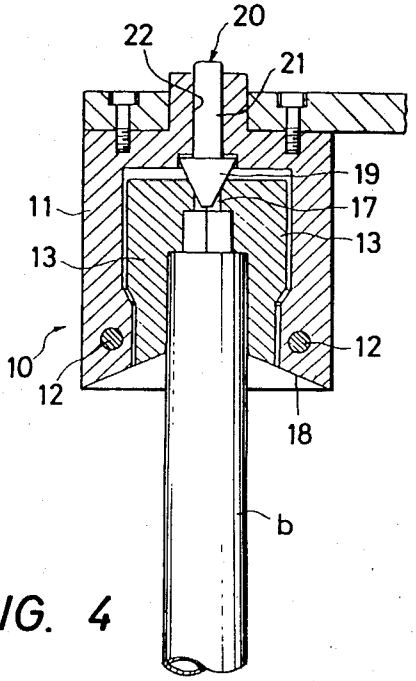
FIG. 4
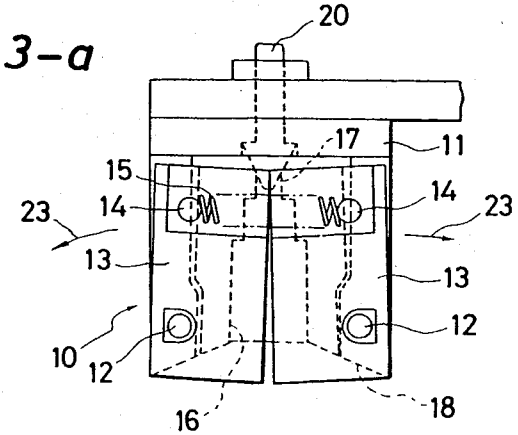
FIG. 3-a
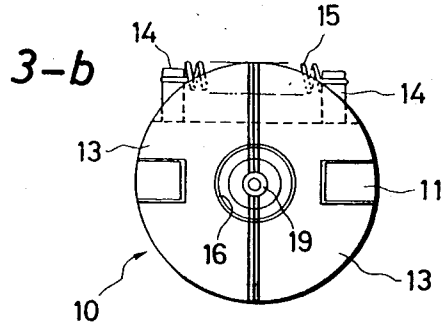
FIG. 3-b

BOBBIN DISTRIBUTING DEVICE

BACKGROUND OF THE INVENTION

The present invention relates to a device for discriminating and distributing bobbins, which are discharged from an automatic winder or the like, in terms of the quantity of yarn wound on the bobbin and/or kinds of the bobbin.

In order to obtain one fully-wound package at an automatic winder, it is necessary to feed a plurality of cops. The bobbins discharged from the winder are divided into empty ones, which have no yarns wound thereon as a result of the complete winding operation, and yarn-left ones which have failed to be knotted at the winding unit of the winder so that they are discharged while still having their yarns left unwound. The former empty bobbins are returned to a fine spinning frame after a predetermined number of bobbins have been stored, whereas the latter ones are either subjected to a yarn end seeking and removing operation again until they are fed to the winder or handled as the empty ones after their yarns left unwound have been removed.

Furthermore, with a view to realizing a multi-kind and medium- or low-rate production system in a textile finishing field, more and more flexibility is required to give more and more importance to the development of bobbin conveying means for coupling textile machines. In case a variety of yarns are to be finished simultaneously under the above-specified circumstances, it is desired to convey a number of bobbins, which are wound with the respective kinds of yarns, commonly along one passage and to administer the respective bobbins in accordance with their kinds. If that desire is satisfied, it is possible to expect relization of a system which is enabled to facilitate arrangement of the respective machines in a textile factory, to eliminate the standby of a machine thereby to improve the working ratio, and to cope flexibly and reliably any change in the production scheme as a whole.

SUMMARY OF THE INVENTION

An object of the present invention is to provide a device for discriminating and distributing bobbins, which are discharged from an automatic winder or the like and conveyed commonly along one passage, in terms of the quantity of residual yarns wound on the bobbin and/or kinds of the bobbin.

The device of the present invention comprises a bobbin chucking means made movable while chucking one end of the bobbin, guide means having a plurality of different guide faces for guiding the movement of the chucking means on the guide faces, sensors for discriminating the quantity of residual yarns wound on the bobbin and/or kinds of the bobbin and means for guiding the chucking means on one of the guide faces in accordance with the instruction of the sensors.

According to the present invention, the bobbins having been discharged from the automatic winder or the like can be automatically selected and distributed in accordance with the yarn kinds and with the presence of the little yarn left. Said selections make possible the administrations of the bobbin numbers in accordance with the yarn kinds and are effective especially in case the automatic winder and the fine spinning frame are connected integrally to conduct a system administration of yarn productions. Furthermore, the selections and distribution can increase and decrease the number of selections in accordance with the yarn kinds. Furthermore, the provision of the present selecting device leads to an advantage that the conveyor passage of the bobbins to be discharged from the automatic winder or the like can be made single.

BRIEF DESCRIPTION OF THE DRAWINGS:

FIG. 3-*a* is a side elevation showing the chucker of the first embodiment;

FIG. 3-*b* is a bottom view of the same;

FIG. 4 is a longitudinally sectional side elevation showing the chucker in a state to chuck the bobbin;

DETAILED DESCRIPTION OF THE INVENTION

Figure 1:
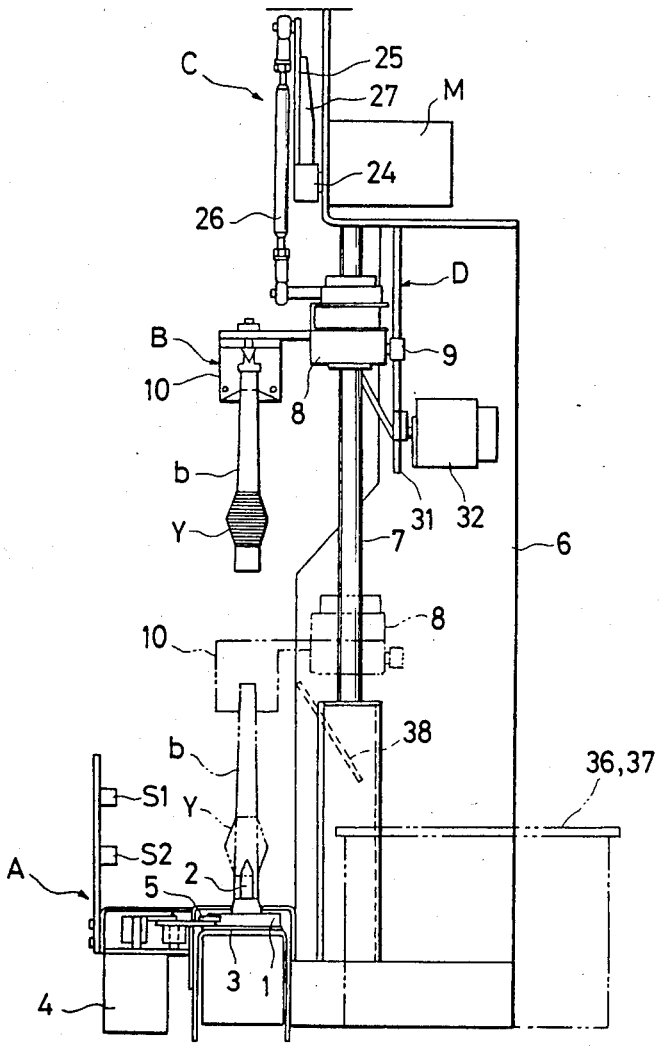
FIG. 1 is a side elevation showing a first embodiment of the present bobbin distributing device.

Now, a first embodiment, in which the bobbins discharged from an automatic winder are discriminated in terms of the quanties of redidual yarns or kinds of the bobbin and are divided into two, will be described referring to FIGS. 1 to 5. In this embodiment, it is assumed that a bobbin b discharged from a not-shown winder is mounted on a peg 2 of a tray 1 and conveyed in an upright position on a conveyor 3. The present distributing device is mainly divided into: a discriminator A, which is arranged close to the aforementioned conveyor 3 for temporarily stopping the tray 1 conveyed on the conveyor 3 and for discriminating the quantity of the yarn Y of the bobbin b mounted on the tray 1; a bobbin chuck B for chucking the upper end of the bobbin b; a lift C for moving up and down the chuck B; and a guide D for guiding the bobbin chuck B, when the latter is to move, to turn the same at a predetermined angle.

The aforementioned discriminator A is equipped with first and second sensors S1 and S2, which are supported in two vertical positions at the side of the conveyor 3, and a stopper 5 which is rotationally driven by the action of a solenoid 4. Thus, all the bobbins b that are conveyed on the conveyor 3 are temporarily stopped by the aforementioned stopper 5 and are then discriminated in terms of their yarn quantities by the sensors S1 and S2. The first sensor S1 operates to detect the left yarn Y wound on the bobbin b when the yarn Y exceeds a predetermined level, whereas the second sensor S2 operates to detect the left yarn Y no more than a predetermined quantity. When the first sensor S1 operates, the aforementioned solenoid 4 operates to retract the stopper 5 thereby to allow the bobbin b having the yarn left more than the predetermined quantity to pass there-through. When not the first sensor S1 but only the second sensor S2 operates, it is determined that the thus sensed bobbin has minimum yarn thereon. Similarly, when the sensors S1 and S2 do not operate either, the bobbin is discriminated to be empty so that the aforementioned stopped state is maintained and is held so as to be lifted by the chucker (described below).

The bobbin chuck B is constructed such that a lifting member 8 is slidably mounted on a rod 7 fixed at the center of the frame 6 of the present distributing device and such that a cam follower 9 and a chucker 10 are carried on the lifting member 8.

The chucker 10 is constructed, as shown in detail in FIGS. 3-*a* and 3-*b* and 4, of a chucker body 11 and a pair of semicircular chucking members 13 and 13 which are borne slightly pivotally on the chucker body 11 by means of pivot pins 12 and 12. The two chucking members 13 are so biased by means of a spring 15, which is mounted under tension between stud pins 14 and 14 anchored respectively at the members 13 and 13, that they have their upper ends abutting against each other in their normal states, as shown in FIG. 3-*a*. Each of the chucking members 13 is formed therein with such a circular bobbin bore 16 as is slightly converging upward in the aforementioned normal state. The bobbin bore 16 has its upper portion formed with a small-diameter portion 17 and its lower portion formed with a diverging face 18. In the upper portion of the chucker body 11, there is mounted a wedge-shaped member 20 which is formed with a conical portion 19 at its lower end. That member 20 has its circular portion 21 fitted slidably in a bore 22 such that its upper end protrudes therefrom and such that its aforementioned conical portion 19 is fitted between the two chucking members 13 and 13.

When the bobbin b is inserted into the bobbin bore 16 of the aforementioned chucker 10, its leading end first comes into contact with the aforementioned converging wall face of the bobbin bore 16 to expand the same, namely, forces in the direction of arrows 23 of FIG. 3-*a* into the clearance between the chucking members 13 until it is clamped and chucked between the chucking members 13 by the force of the spring 15, as shown in FIG. 4. By depressing the upper end of the wedge-shaped member 20, moreover, the conical portion 19 further expands the upper portions of the chucking members 13 and 13 against the force of the spring 15 thereby to allow the bobbin b having been chucked to drop.

The lift C is equipped with: a motor M which is fixed on the upper portion of the aforementioned frame 6; a lever 25 which is fixed on the shaft 24 of said motor M; and an arm 26 providing connection between the lever 25 and the aforementioned lifting member 8. By the drive of the aforementioned motor M, the lever 25 is turned to slide the lifting member 8 along the rod 7 thereby to move up and down the chucker 10. An arcuate plate 27 is secured to the lever 25, and a contact switch 28 is mounted on the side of the frame 6 so that the contact switch 28 detects the aforementioned plate 27, at the time when the chucker 10 comes down near the bobbin b on the conveyor 3, to stop the motor M.

Figure 5:
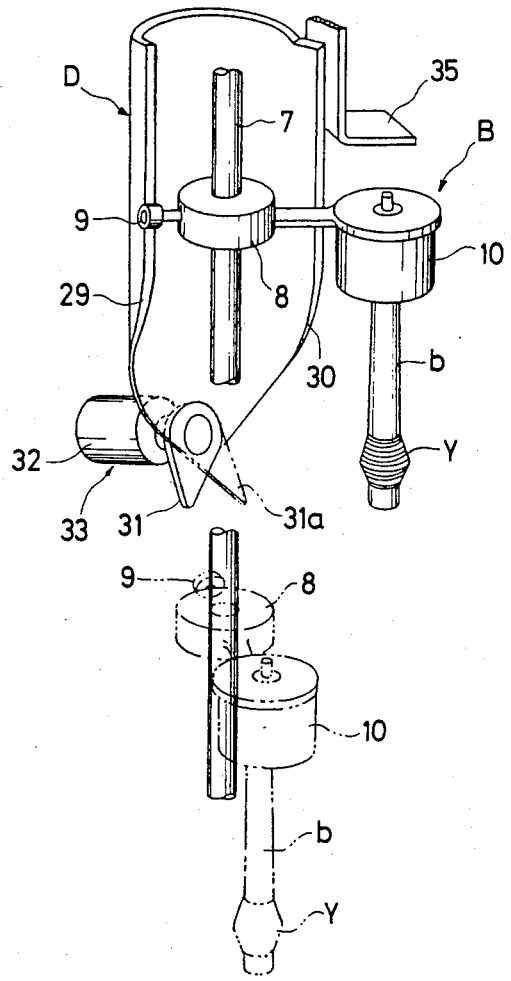
FIG. 5 is a perspective view showing the bobbin chuck device and the guide device.

The guide D is a cylindrical member having an arched cross-section disposed at the back of the rod 7 and has its lower portion cut obliquely and both its side edges formed into smooth guide faces 29 and 30. On the lower end of the guide D, there is mounted switching means 33 which is composed of a switching member 31 having a generally triangular shape, as shown in FIG. 5, and a rotary solenoid 32 for switching the direction of said switching member 31. The rotatory solenoid 32 is operated in response to the instructions of the aforementioned sensors S1 and S2. Specifically, the rotary solenoid 32 switches the direction of the aforementioned switching member 31 in dependence upon whether only the second sensor S2 detects the left yarn Y of the bobbin b or whether none of the two sensors S1 and S2 detect the left yarn Y. When the switching member 31 is located at the double-dotted position 31*a* of FIG. 5, for example, the bobbin chuck B elevated along the rod 7 has its cam follower 9 guided by the aforementioned switching member 31*a* to slide on one guide face 29 so that the cam follower 9 is guided on the other guide face 30 if the switching member 31 is directed to the other side. By the action of the switching member 31, in other words, the chucker 10 having chucked the bobbin b has its position switched to the right and left and is distributed so that it comes into abutment contact, after it has been distributed, with L-shaped stoppers 34 and 35 which are arranged at both the sides of the guide D. At this time, the stoppers 34 and 35 depress the upper end of the wedge-shaped member 20 of the chucker 10 whereby the bobbin b is released to drop down from the chucker 10, as has been described in the above.

The present distributing device has the construction thus far described, and its operation will be schematically repeated in a sequentially manner in the following.

Figure 2:
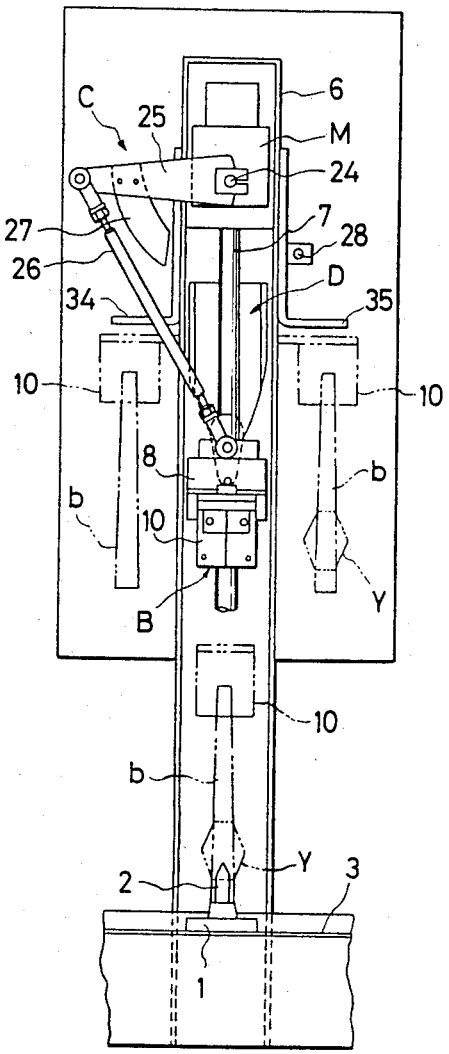
FIG. 2 is a front elevation of the device in FIG. 1.

When the quantity of the left yarn Y of the bobbin b is discriminated by the sensors S1 and S2 in the aforementioned manner, the stopper 5 retracts, in case the left yarn Y exceeds the predetermined quantity, so that the bobbin b is conveyed to another not-shown readying device for seeking and removing yarn ends from a spinning cop. In case the left yarn Y is less than the predetermined quantity, the motor M is energized. At this time, the chucker 10 is located just above the bobbin b by the aforementioned actions of the plate 27 and the contact switch 28 so that it is driven down by the aforementioned motor M until it is lifted while chucking the upper end of the bobbin b. During this rise, the switching operation of the switching member 31 has already been conducted in accordance with the instructions of the aforementioned sensors S1 and S2 so that the cam follower 9 is guided by one of the two guide faces 29 and 30 of the guide D in accordance with the direction of said switching member 31. In the example of FIG. 2, the chucker 10 is distributed to the right position, if there exists the left yarn Y, but is distributed to the left position in the case of the empty bobbin. Meanwhile, the plate 27 leaves the contact switch 28 whereby the stopper 5 releases the tray 1 to restore the stopper 5 to its initial position. When the chucker 10 comes to its uppermost position, its wedge-shaped member 20 has its upper end depressed by the stoppers 34 and 35 so that the bobbins b are released by the chucker 10 until they drop one by one to be stored in containers 36 and 37 disposed thereunder. Incidentally, reference numeral 38 indicates a guide plate for guiding the dropping bobbins. The sequential operations thus far described are repeated each time the bobbin b being conveyed on the conveyor 3 is caught by the stopper 5 so that the bobbins discharged from the winder can be distributed into those, which have yarns left more than the predetermined level so that their readying operations for seeking the yarn ends are to be tried again, those, which have so little yarn left so that the left yarn has to be removed, and those which are so empty that they are returned as they are to the fine spinning frame. The bobbins thus distributed can be stored separately in the different containers.

In the above explanation, it is described that the bobbins are selected and distributed in terms of the quantities of the yarns left on the bobbin. However, it is noted that the bobbins may be selected and distributed in terms of the kinds of yarn by constituting the device to have a sensor discriminating two kinds of trays which carry bobbins with two kinds of yarns respectively, and to operate the guide means according to the yarn kinds.

A second embodiment of the present invention, in which a plurality kinds of bobbins conveyed on single conveyor are selected and distributed in accordance with the kinds of the bobbin and the quantities of yarns left on the bobbin, will be described with reference to the accompanying drawings.

Figure 6:
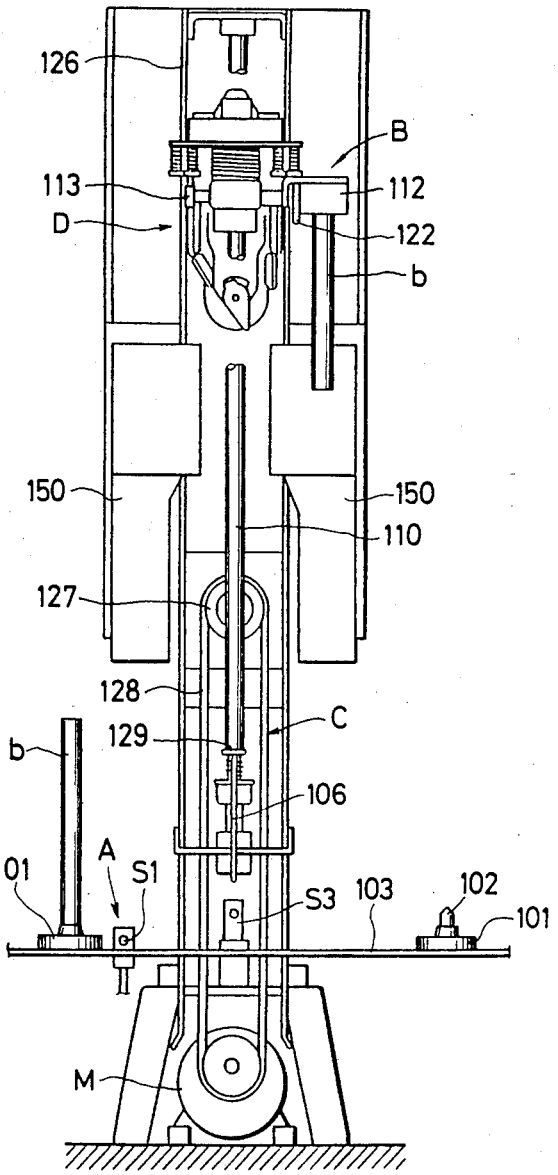
FIG. 6 is a front elevation showing a second embodiment of the present bobbin distributing device.
Figure 7:
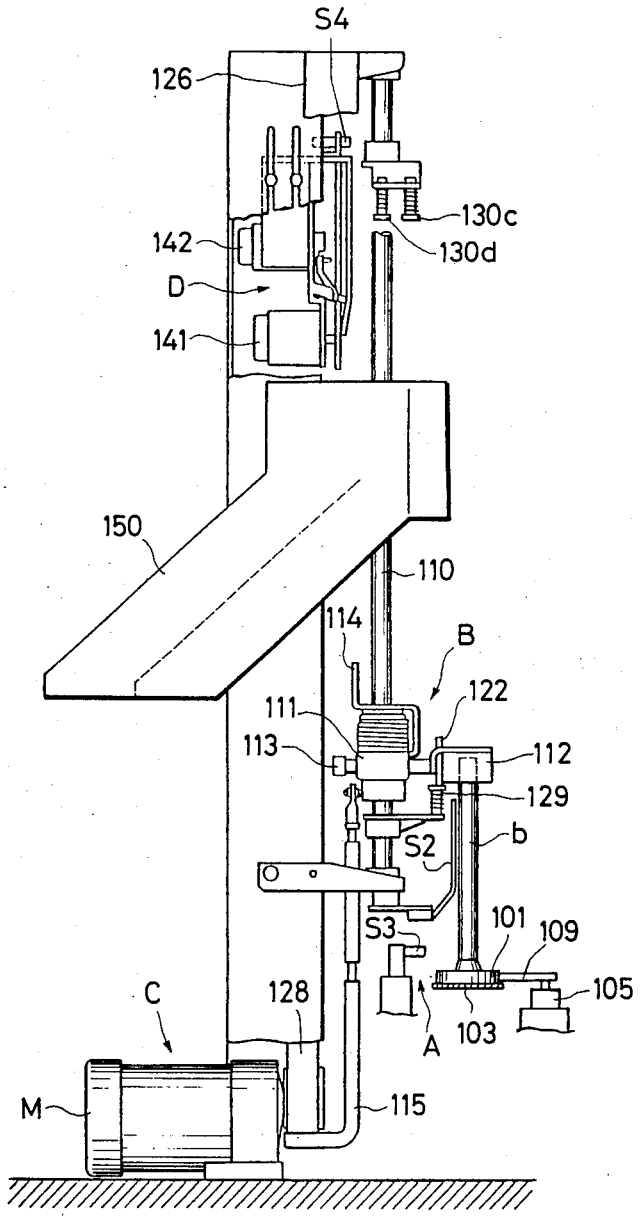
FIG. 7 is a side elevation of the same.
Figure 8:
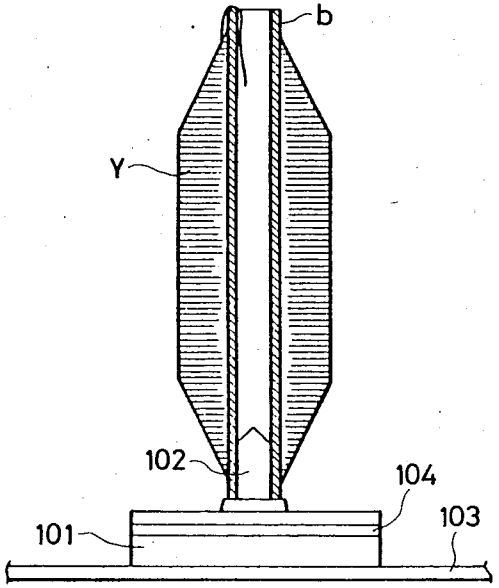
FIG. 8 is a partially longitudinally sectional side elevation showing the tray and the bobbin.

FIGS. 6 and 7 show the whole construction of a bobbin selecting and distributing device according to the second embodiment of the present invention. In the present device, it is assumed that a bobbin b, which has its yarn wound off by a not-shown automatic winder so that it is discharged therefrom, be fitted on a peg 102 standing on a disc-shaped tray 101, as shown in FIG. 8, and be conveyed in an upright position on a belt conveyor 103. In the aforementioned winder, it is also assumed that two kinds of yarn be wound simultaneously, and that the respective bobbins b are supported on the two kinds of tray 101 in accordance with the aforementioned yarn kinds. The kinds of the trays 101 are indicated either by a mark 104 shown in FIG. 8 or by their color or shape and are discriminated by sensors, which will be described hereinafter. The present device is divided majorly into: a discriminator A which is disposed close to the aforementioned conveyor 3 for effecting discriminations to stop or pass the trays 101 and the bobbins b both being conveyed down on said conveyor 103; a bobbin chuck B for chucking the upper end of the bobbin b which is stopped by said discriminator A; a lift C for moving up and down said chuck B; and a guide D for guiding the movement of the aforementioned chuck B.

Figure 9:
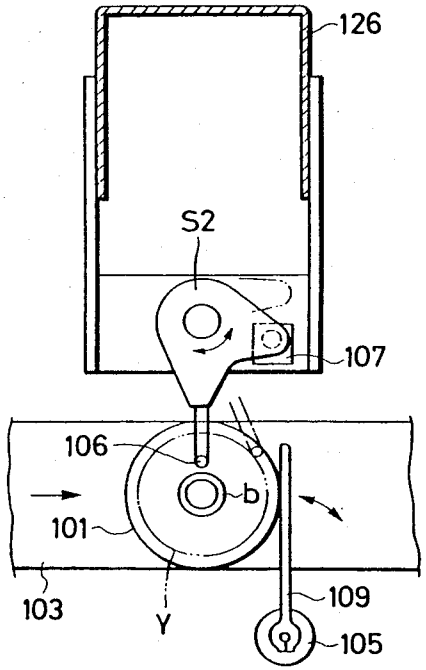
FIG. 9 is a top plan view for explaining the second sensor and the tray stopper.

The discriminator A is constructed of: a first sensor S1 for discriminating the aforementioned mark 104 of the tray 101; second and third sensors S2 and S3 disposed downstream of said first sensor S1 and on the present selecting and distributing device; and a tray stopper 105 for stopping the tray 101, which is being conveyed on the conveyor 103, in front of the present distributing device. The aforementioned first and third sensors S1 and S3 are those of photoelectric reflection type, whereas the second sensor S2 is equipped with a detecting bar 106 which is positioned remarkably close to the bobbin b being conveyed on the conveyor 103, so that in case said bobbin b has a number of windings of the yarn Y the aforementioned detecting bar 106 comes into contact with the yarn layer to swing, as shown in FIG. 9. This swing of the detecting bar 106 is detected because it carries a contact switch 107 at its one end, so that when the swing is detected the tray stopper 105 is made inoperative to allow the tray 101 to pass as it is on the conveyor 103. Reference numeral 108 appearing in FIG. 10 indicates a torsion spring for returning the detecting bar 106 to its initial position. The third sensor S3 is one for detecting whether or not a little yarn is left on a portion of the bobbin b. The tray stopper 105 is made operative to swing a bar-shaped stopper 109 by means of a rotary solenoid thereby to stop the tray 101 and is brought into operation in case the aforementioned second sensor S2 does not detect the yarn Y.

Figure 10:
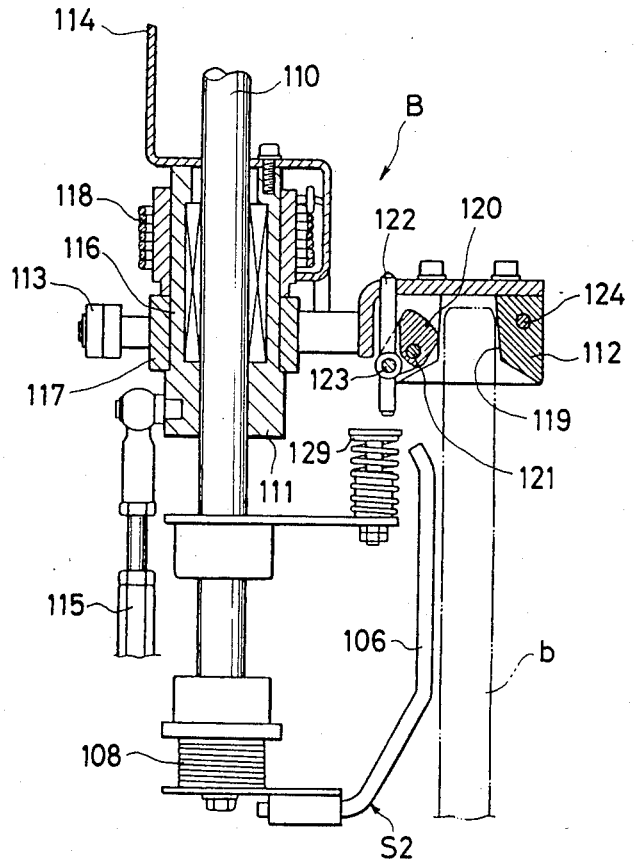
FIG. 10 is a longitudinally sectional side elevation showing the bobbin chuck of the second embodiment.
Figure 12:
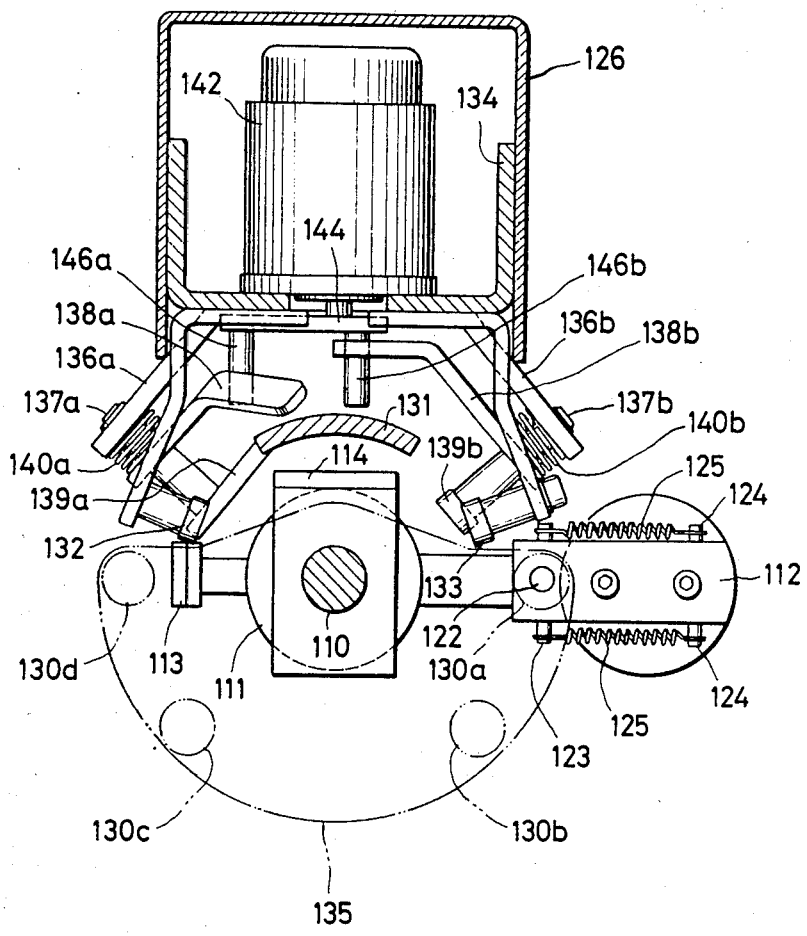
FIG. 12 is a transverse top plan view of the same.

The bobbin chuck B is constructed by mounting a lifting member 111 slidably on a rod 110 fixed to the center of the present selecting device and by carrying a chucker 112 and a cam follower 113 on said lifting member 111. The detail of this construction is shown in FIG. 10, in which the lifting member 111 is equipped with a protrusion 114 at its upper end and with a later-described L-shaped member 115 at its lower end. The lifting member 111 is made movable up and down along the rod 110 by the action of a thrust bearing 116 and supports a ring 117, which fixes the chucker 112 and the cam follower 113, rotatably on the outer circumference of said lifting member 111. On the other hand, said ring 117 has its rotations restrained by the action of a torsion spring 118. The chucker 112 is formed in its lower face with a recess 119 for receiving the upper end of the bobbin b. In the chucker 112 there is borne by means of a pivot pin 121 a cam member 120 which is adapted to come into and out of the recess 119 when it rotates. The cam member 120 has its one end connected by means of a pin 123 to a pin 122, which is supported movably up and down on the chucker 112, so that if the lower end of the pin 123 is depressed the cam member 120 rotates to have its portion protruding into the recess 119 whereas the upper end of the pin 122 is depressed the cam member 120 retracts out of the recess 119. As shown in FIG. 12, two springs 125 and 125 are mounted under tension between the aforementioned pin 123 and pins 124 and 124, which protrude to the outside of the chucker 112, so that the cam member 120 is biased to take eigher of the aforementioned protruding and retracted positions by the tensile forces of the springs 125 and 125.

The lift C is equipped with: a motor M disposed at the lower end of a frame 126; a pulley 127 disposed at the central position of the frame 126; an endless belt 128 made to run between said pulley 127 and the pulley of the aforementioned motor M; the aforementioned L-shaped member 115; a fourth sensor S4; and a group of stoppers 129, 130*a*, 130*b*, 130*c* and 130*d*. The aforementioned lifting member 111 is connected to the aforementioned belt 128 by means of the L-shaped member 115 so that the lifting member 111 is moved up and down along the rod 110 by the run of the belt 128 which is driven by the motor M actuated by the action of the aforementioned second sensor S2. The fourth sensor S4 is a contact switch which is fixed to the upper end of the frame 126 and which is made operative to detect the aforementioned protrusion 114 thereby to stop the lifting member 111 at its uppermost position. The rod 110 has its lower end equipped with the stopper 129 and its upper end equipped with the four stoppers 130*a*, 130*b*, 130*c* and 130*c* so that the stopper 129 comes into contact with the pin 122 of the chucker 112, when the lifting member 111 comes to its lowermost position, whereas one of the aforementioned stoppers 130*a*, 130*b*, 130*c* and 130*d* comes into contact with the pin 122 to retract the cam member 120 when the lifting member 111 comes to the uppermost position.

Figure 11:
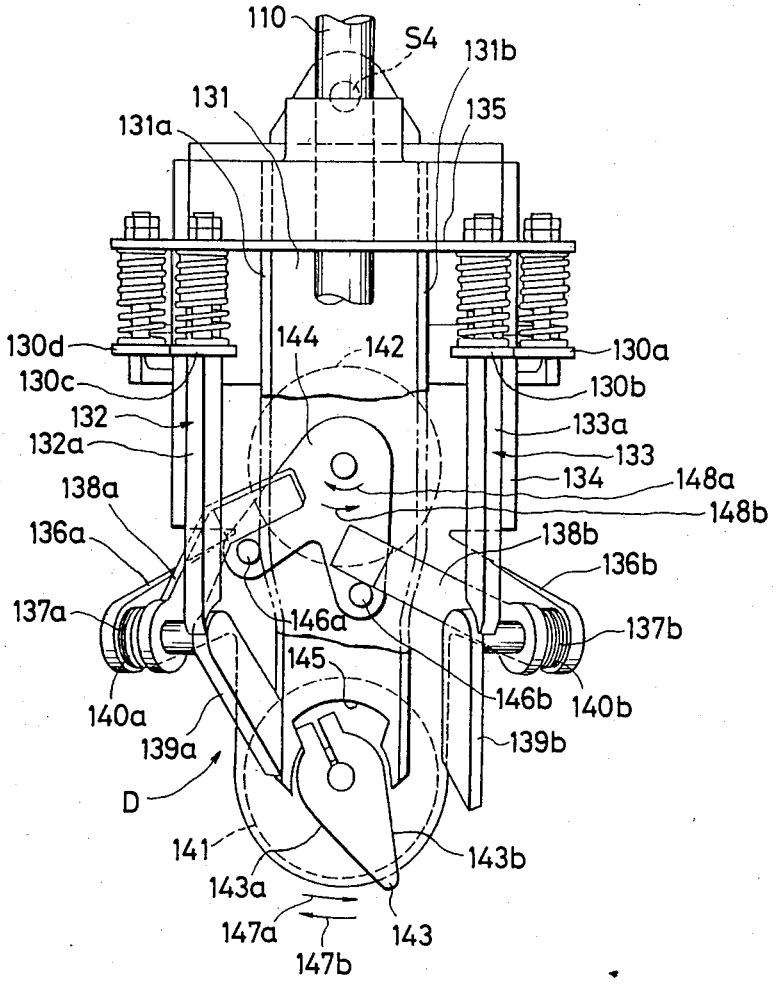
FIG. 11 is a front elevation showing the guide device.

The guide D is disposed in the upper portion of the frame 126, as shown in FIGS. 11 and 12, and is constructed of: three guide plates 131, 132 and 133; a variety of switching means; and a base 134 supporting the former members. Those guide plates are divided into: a central guide plate 131 positioned at the center and formed with guide face 131*a* and 131*b* at its two sides; and the left and right guide plates 132 and 133 positioned at the two sides of the guide plate 131 and formed with guide faces 132*a* and 133*a* at their respective outer sides. These guide plates are fixed on the aforementioned base 134 together with a stopper supporting plate 135 which supports the aforementioned stoppers 130*a*, 130*b*, 130*c* and 130*d*. From both the sides of said base 134, there extend arms 136*a* and 136*b* equipped at their leading ends with pivot pins 137*a* and 137*b*, on which operating levers 138*a* and 138*b* and guide levers 139*a* and 139*b* are supported together in swinging manners. The aforementioned guide levers 139*a* and 139*b* are also formed on their respective outer sides with guide faces, which can provide smooth communications of the leading end portions of the centeral guide plate 131 and the left and right guide plates 132 and 133 when the guide levers 139*a* and 139*b* swing. Incidentally, letters 140*a* and 140*b* indicate torsion springs which are mounted on the aforementioned pivot pins 137*a* and 137*b* for returning the guide levers 139*a* and 139*b*. To the back of the central guide plate 131, there are fixed two rotary solenoids 141 and 142 having shafts, to which switching members 143 and 144 are fixed, respectively. The first switching member 143 at the lower side is positioned in a notch 145, which is formed in the lower end of the central guide plate 131, whereas the second switching member 144 at the upper side has one end, to which two pins 146*a* and 146*b* are fixed. The first switching member 143 is formed into such a sharpened shape as is formed with the guide faces 143*a* and 143*b* at both its sides, and is swung in the directions of arrows 147*a* and 147*b* by the actuation of the first rotary solenoid 141. The second switching member 144 is swung in the directions of arrows 148*a* and 148*b* by the actuation of the second rotary rolenoid 142 so that their pins 146*a* and 146*b* alternately push up the aforementioned operating levers 138*a* and 138*b*, when they swing, whereby the respective guide levers 139*a* and 139*b* connect or open the central guide plate 131 and the left and right guide plates 132 and 133.

The operations of the bobbin selecting device thus far described will be explained in the following.

When the tray 101 supporting the bobbin b comes down on the conveyor 103, the first sensor S1 first discriminates the kind of said tray 101 in terms of the mark 104 so that the rotary solenoid 141 is energized to bring the first switching member 143 into the position shown in FIG. 11. Next, in case the second sensor S2 detects none of the yarn on the bobbin b and the third sensor S3 detects little yarn left, the pin 146*a* of the second switching member 144 is actuated by the second rotary solenoid 142 to raise one operating lever 138*a* to support the guide lever 139*a* together with said lever 138*a* at the position shown in FIG. 11, and the tray stopper 105 is operated to stop the aforementioned tray 101. The lifting member 111 has its uppermost position providing a stand-by position, and the motor M is driven simultaneously with the operations of the aforementioned second and third sensors S2 and S3 to start the running operation of the belt 128 so that the lifting member 111 connected to the belt 128 by means of the L-shaped member 115 starts quietly its downward movement. When the lifting member 111 comes to its lower-most position, the pin 122 of the chucker 112 abuts against the stopper 129 to rotate the cam member 120. At this time, the upper end of the bobbin b having been stopped by the aforementioned tray stopper 105 is inserted in the recess 119 of the chucker 112. As a result, the upper end is depressed by the cam member 130 so that the bobbin b is chucked by the chucker 112. The lifting member 111 is shifted to its rising stroke from that state to pull off the bobbin b from the tray 101, and then the tray stopper 105 is actuated to release the empty tray 101 by the action of a not-shown timer. Midway of the aforementioned rise, the cam follower 113 abuts against the first switching member 143 and is shifted from the left guide face 143*a* through the central guide plate 131 and the left guide lever 139*a* to the guide face 132*a* of the left guide plate 132. In accordance with this, the bobbin chuck B rises, while swinging by 190 degrees, against the biasing force of the torsion spring 118 until it takes the position shown in FIG. 6. When the bobbin chuck B reaches its uppermost position, its protrusion 114 is detected by the fourth sensor S4 so that the drive of the motor M is stopped. Simultaneously with this, the pin 122 of the chucker 112 is depressed upward by the stopper 130*a* to retract the cam member 120 out of the recess 119 so that the bobbin b is released to drop into the chute 150 which is fixed to the frame 126. If the tray 101 instead carried an empty bobbin b for the same kind of yarn as discussed above, then first switching member 143 would remain in the position shown in FIG. 11 but neither sensor S2 nor S3 would detect any yarn. The second rotary solenoid 142 would therefore not be actuated and, consequently the operating lever 138*a* would not be raised by the pin 146*a* of the second switching member 144. The guide lever 139*a* would therefor not contact the guide surface 131*a* as shown in FIG. 11 but would instead have an orientation similar to that shown for guide lever 139*b* in FIG. 11. As lifting member 111 rises, the cam follower 113 would again abut the left guide face 143*a* of the first shifting member 143 and then engage the guide face 131*a* of the central guide plate 131 instead of the previously engaged guide face 132*a* of the guide plate 132. The bobbin b would then be released when the stopper 130*b* depressed pin 132 of the chucker 112.

If the tray 101 having been conveyed on the conveyor 103 belongs to a different kind, the first switching member 143 is swung in the direction of arrow 147*b* by the action of the first sensor S1. At this time, the cam follower 113 is guided along the right guide face 143*b* of said first switching member 143 with guide lever 139*b* respectively positioned similarly to the orientations described above with respect to guide lever 139*a*. The operations of the first and second rotary solenoids 141 and 142 are illustrated in following table, in which: letters $X_1$ and $X_2$, and $Y_1$ and $Y_2$ indicate the trays 101 $X_1$, $X_2$ respresenting trays 101 carrying bobbins for one kind of yarn and $Y_1$, $Y_2$ respresenting trays 101 carrying bobbins for a second kind of yarn; letters $X_1$ and $Y_1$ representing the empty bobbins b for the differing kinds of yarn; letters $X_2$ and $Y_2$ representing the bobbins b having differing kinds of little yarn left; letters ON representing the swings of the first and second switching members 143 and 144 in the directions of the arrows 147*a* and 148*a*, respectively; and letters OFF representing swings in the reverse directions 147*b* and 148*b* respectively.

TABLE

| | $X_1$ | $X_2$ | $Y_1$ | $Y_2$ |
|---|---|---|---|---|
| the first rotary solenoide 41 | OFF | OFF | ON | ON |
| the second rotary solenoid 42 | OFF | ON | ON | OFF |

Figure 13:
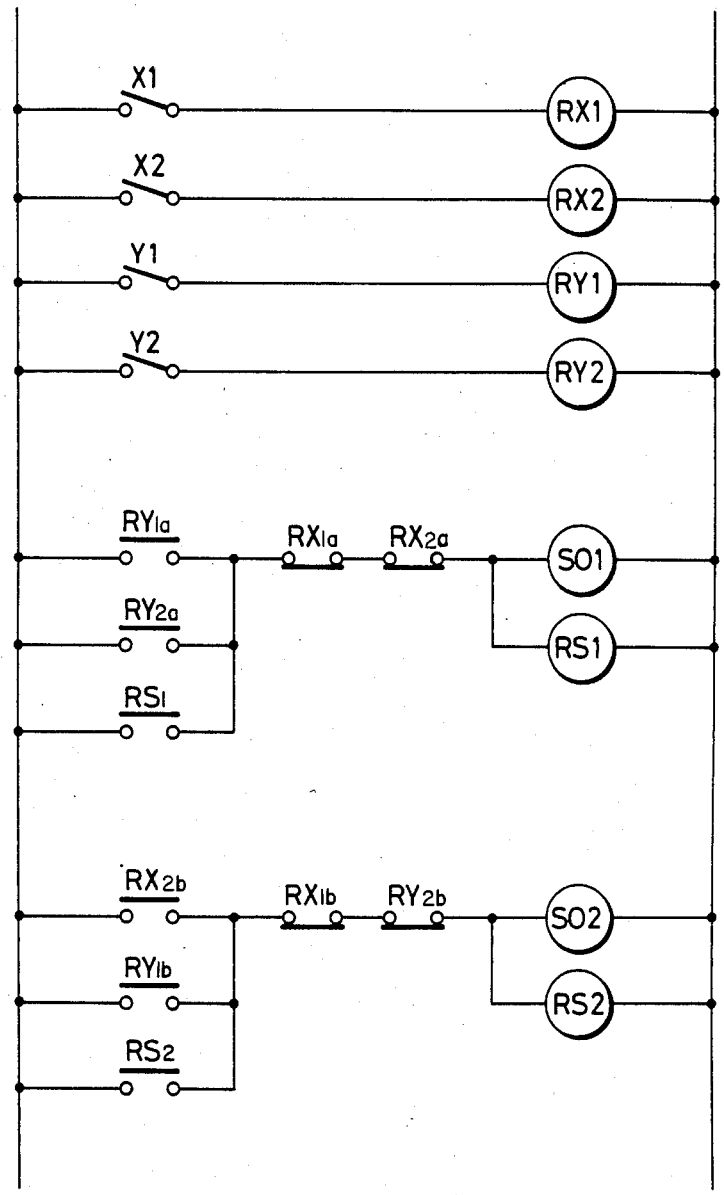
FIG. 13 is a circuit diagram for realizing the operation of the first and second rotary solenoids.

FIG. 13 is a circuit diagram for realizing the operation of the first and second rotary solenoids. SO1 designates the first rotary solenoid 141 and SO2 designates the second rotary solenoid 142, respectively. RX1, RX2, RY1 and RY2 respectively designate relays actuated by the closure of corresponding contacts X1, X2, Y1 and Y2. The elements $RY_{1a}$, $RY_{2a}$, $RS_1$, $RX_{2b}$, $RY_{1b}$, and $RS_2$ respectively designate normally open contacts closed by the actuation of the corresponding relays RY1, RY2, RS1 and RS2 while $RX_{1a}$, $RX_{2a}$, $RX_{1b}$ and $RY_{2b}$ represent normally closed contacts opened by the actuation of the corresponding relays RX1, RX2 and RY2. The relays RS1 and RS2 and their corresponding normally open contacts $RS_1$ and $RS_2$ respectively form selfholding circuits to maintain relays SO1 and SO2 in an energized state until the subsequent opening of the respective pairs of normally closed contacts $RX_{1a}$, $RX_{2a}$ and $RX_{1b}$, $RY_{2b}$. More specifically, if the bobbin b conveyed down is wound with the sufficient yarn Y, it is allowed to pass by the action of the second sensor S2. If that bobbin b is not sufficiently wound, it is stopped by the tray stopper 105.

This is accomplished by the circuit of FIG. 13 as follows. If the bobbin is an X-kind bobbin and is an empty bobbin, the contact X1 is operated to actuate the relay RX1 and the closed contacts $RX_{1a}$ and $RX_{1b}$ are opened. Thus, the first and second solenoids SO1 and SO2 are not actuated and are kept "OFF." Accordingly, the first and second switching members 143 and 144 are not operated and the X-kind bobbin is guided and transferred to the determined position. The other cases are operated in the same manner as is described above. For example, if the bobbin is an X-kind bobbin having little yarn left, the contact X2 is operated to actuate the relay RX2, opening the normally closed contact $RX_{2a}$ (assuring solenoid SO1 remains "OFF") and closing the normally open contact $RX_{2b}$ to actuate solenoid SO2 (as shown from the above table). The X-kind bobbin having little yarn left is then guided and transfered to a predetermined chucker release position differing from the position for an empty X-kind tray. Similarly an empty Y-kind tray and a Y-kind tray with little yarn left respectively activate contacts Y1 and Y2 to achieve proper guiding and transferring of these respective Y-kind trays by the chucker 112 to differing predetermined chucker release positions. By the action of the first sensor S1, the direction of the first switching member 143 is so changed in accordance with the kind of the tray 101 that the cam follower 113 is switched and guided to the left or right of the central guide plate 131. By the action of the third sensor S3, it is detected whether or not a little yarn is left on the aforementioned bobbin b. In accordance with this result, the guide levers 139*a* and 139*b* are swung to one of the two positions, in which they guide the cam follower 113 on the guide faces 131*a* and 131*b* of the central guide plate 131 and in which they guide the cam follower on the guide faces 132*a* and 133*a* of the left and right guide plates 132 and 133. In other words, the bobbin b having little or no yarn Y has its position of release from the chucker 112 switched between any one of four totally different release positions in accordance with the kinds of the tray 101 and the presence or absence of the little yarn left. The aforementioned stoppers 130*a*, 130*b*, 130*c* and 130*d* and chutes 150 are provided at each of the four release positions. The bobbin b having been sorted and discharged through said chute 150 is stored in a not-shown container or is returned to a fine spinning frame by means of a conveyor.

According to the present bobbin selecting and distributing device thus far described, it is assumed that the bobbins b wound with two kinds of yarn be supported on the trays 101 of different kinds according to the yarn kinds, and that the bobbin b can be selected and discharged in accordance with the kinds of said trays 101 and with the quantity of the yarn Y wound on the aforementioned bobbins b. Therefore, unless the presence of the little yarn left is considered, four kinds of bobbins can be selected and divided by the present selecting and distributing device. In case the selections of many kinds of bobbins are to be conducted by one selecting and distributing device, moreover, they can be coped with by attaching similar guide plates and guide levers to the outer sides of the aforementioned left and right guide plates 132 and 133 thereby to increase the numbers of the stoppers, chutes and so on. Still moreover, the indications of the aforementioned yarn kinds may resort not to the marks 104 of the trays 101 but to the bobbins b themselves.

What is claimed is:

1. A bobbin distributing device comprising:

sensing means for discriminating between an empty bobbin and a bobbin having a first predermined quantity of yarn wound on a bobbin and for providing a signal indicative of the quantity of yarn wound on a bobbin;

bobbin chucking means for chucking one end of said bobbin and moving with a bobbin in response to a signal from said sensing means;

guide means having a plurality of different guide faces for guiding the movement of said chucking means on said guide faces; and switching means carried on the respective leading ends of said guide faces for receiving a signal from the switching means and switching and guiding said chucking means on one of said guide faces in response to a signal from said sensing means.

2. A bobbin distributing device as claimed in claim 1, wherein said sensing means comprises first and second sensors and further includes a stopper means rotationally driven by a solenoid, provided at the side of the conveyor, said stopper means for temporarily stopping all bobbins, said sensor means for discriminating the stopped bobbins in terms of their yarn quantities so that the bobbins are either discriminated to be ones having yarn of more than the predetermined quantity so as to be allowed to pass through the stopper, or, are discriminated to be ones having the minimum yarn thereon, or, to be empty ones having no yarn.

3. A bobbin distributing device as claimed in claim 1, wherein said bobbin chucking means comprises a rod fixed at the center thereof, a lifting member slidably mounted on the rod, a cam follower secured to the lifting member, and a chucker carried on the lifting member.

4. A bobbin distributing device as claimed in claim 3, wherein said chucker is constructed of a chucker body, a pair of semi-circular chucking members which are borne slightly pivotally on the chucker body, a spring being biased between the two chucking members, and a wedge-shaped member which is formed with a conical portion fitted between the two chucking members, each of said chucking member having a circular bobbin bore into which the upper end of the bobbin is inserted and clamped thereby.

5. A bobbin distributing device as claimed in claim 4, wherein said guide means is a cylindrical member having an arched cross-section disposed at the back of the rod and has its lower portion cut obliquely and both its side edges formed into smooth guide faces on which the cam follower of the bobbin chucking means is guided on the guide faces.

6. A bobbin distributing device as claimed in claim 5, wherein said switching means comprises a substantially triangular shaped switching member which is mounted on the lower end of the guide means and a rotatory solenoid operated in response to the instructions of the first and second sensors.

7. A bobbin distributing device as claimed in claim 1, wherein the respective bobbins are supported on different kinds of trays in accordance with the yarn kind wound on the bobbin and the different kinds of the trays are indicated either by a mark or by their color or shape which can be discriminated by the sensing means.

8. A bobbin distributing device as claimed in claim 7, wherein said sensing means further comprises a first sensor for discriminating the mark of the tray, second and third sensors and a tray stopper for stopping the tray in front of the distributing device, said second sensor having means for detecting a quantity of windings of yarn on the bobbin and actuating the stopper, and said third sensor having means for detecting whether or not a little yarn is left on the bobbin.

9. A bobbin distributing device as claimed in claim 1 or 8, wherein said bobbin chucking means comprises a rod fixed at the center thereof, a lifting member slidably mounted on the rod, a cam follower secured to the lifting member, and a chucker carried on the lifting member.

10. A bobbin distributing device as claimed in claim 9, wherein said chucker includes a recess formed in the lower face thereof to receive the upper end of the bobbin, a cam member which is pivoted and adapted to come into and out of said recess when it rotates, and a means for rotating the cam member.

11. A bobbin distributing device as claimed in claim 10, wherein said guide means comprises a central guide plate which is positioned at the center and formed with guide faces at its two sides, left and right guide plates which are positioned at the two sides of the central guide plate and formed with guide faces at their respective outer sides, a base supporting said three guide plates, and two guide levers which are supported on the base in a swinging relationship, said guide levers having on their respective outer sides guide faces and being able to provide smooth communications of the leading end portions of the central guide plate and the left and right guide plates when the guide levers swing, so that the cam follower can be guided along the guide faces of the guide plates and guide lever.

12. A bobbin distributing device as claimed in claim 11, wherein said switching means comprises a first switching member which is fixed to a shaft of a first rotary solenoid and positioned at the lower end of the central guide plate, said first switching member having a sharpened shape with guide faces at both its sides and capable of being swung, and a second switching member which is fixed to a shaft of a second rotary solenoid and capable of being swung, the respective guide levers actuated for connecting or opening the central guide plate and the left and right guide plates dependent upon the swinging movement of said second switching member.

13. A bobbin distributing device comprising:

sensing means for sensing a predetermined quantity of yarn wound on a bobbin and providing a signal indicative of the yarn quantity;

chucking means for selectively chucking said bobbin and moving the bobbin to one of a plurality of discharge positions;

guide means for guiding both bobbin movement and chucking by said chucking means in response to a signal received from said sensing means.

14. The bobbin distributing device of claim 13 wherein said chucking means further includes means for releasing a bobbin after movemement and chucking.

* * * * *